US007278907B2

(12) United States Patent
Nakamura et al.

(10) Patent No.: US 7,278,907 B2
(45) Date of Patent: Oct. 9, 2007

(54) METHOD OF ADHERING POLISHING PADS AND JIG FOR ADHERING THE SAME

(75) Inventors: Yoshio Nakamura, Nagano (JP); Harumichi Koyama, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 0 days.

(21) Appl. No.: 11/514,180

(22) Filed: Sep. 1, 2006

(65) Prior Publication Data

US 2007/0054606 A1 Mar. 8, 2007

(30) Foreign Application Priority Data

Sep. 5, 2005 (JP) ..... 2005-256511

(51) Int. Cl.
*B24B 1/00* (2006.01)

(52) U.S. Cl. ..... 451/56; 451/28; 451/458

(58) Field of Classification Search ..... 451/56, 451/72, 444, 28, 291, 458–460, 490
See application file for complete search history.

(56) References Cited

U.S. PATENT DOCUMENTS 2,600,747 A 6/1952 Faust
3,840,102 A 10/1974 Dawson
4,674,236 A * 6/1987 Kawakami et al. ..... 451/56
6,254,461 B1 * 7/2001 Benning et al. ..... 451/56
7,090,572 B2 * 8/2006 Ito ..... 451/458

FOREIGN PATENT DOCUMENTS

JP 59-53151 A 3/1984
JP 9-239657 A 9/1997

* cited by examiner

*Primary Examiner*—Dung Van Nguyen
(74) *Attorney, Agent, or Firm*—Birch, Stewart, Kolasch & Birch, LLP

(57) ABSTRACT

The method of adhering polishing pads is capable of easily adhering the polishing pads without damages. The method comprises the steps of: tentatively adhering the polishing pads to polishing plates; attaching a roller unit having a shaft and a roller member, which is capable of rotating about the shaft and which has a projected section having a prescribed width and spirally formed in an outer circumferential face, on the lower polishing plate in the radial direction; moving the upper polishing plate downward, by the holding unit, until the upper polishing plate contacts the roller member; and simultaneously adhering the polishing pads onto the upper and lower polishing plate by rotating the upper and polishing plates in the opposite directions at the same speed with pressing the roller member by the upper polishing plate.

14 Claims, 4 Drawing Sheets

METHOD OF ADHERING POLISHING PADS AND JIG FOR ADHERING THE SAME

BACKGROUND OF THE INVENTION

The present invention relates to a method of adhering polishing pads of a polishing apparatus, which is capable of simultaneously polishing both side faces of a work piece, and a suitable jig for the method.

In a polishing apparatus capable of simultaneously polishing both side faces of a work piece, e.g., wafer, a carrier holding the work piece is rotated between a lower polishing plate and an upper polishing plate, which are independently rotated, so that the both side faces of the work piece can be simultaneously polished by polishing pads, which are respectively adhered on the upper and the lower polishing plates.

A mechanism for rotating carriers is shown in FIG. 7. In FIG. 7, a plurality of carriers 208 are engaged with an internal gear 204 and a sun gear 206, which is located at the center of the internal gear 204.

Gear teeth are formed in an outer circumferential face of each of the disk-shaped carriers 208. The gear teeth engage with inner gear teeth of the internal gear 204 and outer gear teeth of the sun gear 206, so that each of the carriers 208 is rotated and moved around the sun gear 206.

A plurality of the carriers 208 are provided between the internal gear 204 and the sun gear 206, and each of the carriers 208 has a plurality of through-holes 207, in each of which the work piece to be polished is held. With this structure, a plurality of work pieces can be simultaneously polished. An example of such polishing apparatus is disclosed in Japanese Patent Gazette No. 9-239657.

Note that, in the polishing apparatus disclosed in the Japanese gazette, inner pin gears act as the sun gear, and outer pin gears act as the internal gear.

In the above described polishing apparatus, the polishing pads, which are respectively adhered on the upper and lower polishing plates, must be periodically exchanged. A method and an apparatus for adhering polishing pads is disclosed in Japanese Patent Gazette No. 59-53151. In the method, the polishing pads are adhered by the steps of: tentatively adhering the polishing pads on polishing faces of an upper and lower polishing plates; clamping a roller, which is rotatably held, between the upper and lower polishing plates; and rotating the upper and lower polishing plates in the opposite directions so as to fully adhere the polishing faces of the polishing plates.

In a large polishing plate, on which the polishing pad is adhered, circumferential velocities of an inner part of the polishing plate and an outer part thereof are clearly different. If the polishing plate is small, the velocity difference can be ignored for exchanging the polishing pad. However, these days, large polishing plates have been required. Therefore, the velocity difference between the inner part and the outer part of the large polishing plate cannot be ignored. In some cases, the roller bites the polishing pad, especially an inner part of the polishing pad is apt to be damaged.

SUMMARY OF THE INVENTION

The present invention was conceived to solve the above described problems.

An object of the present invention is to provide a method of adhering polishing pads of a polishing apparatus capable of polishing both sides of a work piece, which is capable of easily adhering the polishing pads without damages.

Another object is to provide a suitable jig for said method.

To achieve the objects, the present invention has following structures.

Namely, the method of adhering polishing pads in a polishing apparatus including: a lower polishing plate having a polishing face, on which the polishing pad is adhered; an upper polishing plate being provided above the lower polishing plate and held by a holding unit, the upper polishing plate having a polishing face, on which the polishing pad is adhered; a carrier for holding a work piece, the carrier being provided on the lower polishing plate and engaged with a sun gear and an internal gear, wherein an upper face and a lower face of the work piece are simultaneously polished by rotating and moving the carrier around the sun gear and rotating the upper and lower polishing plates, the method comprises the steps of:

tentatively adhering the polishing pads to the upper and lower polishing plates;

attaching a roller unit having a shaft, which includes connector sections to be attached to the sun gear and the internal gear, and a roller member, which is capable of rotating about the shaft and which has a projected section having a prescribed width and being spirally formed in an outer circumferential face, to the sun gear and the internal gear by the connector sections so as to attach the roller unit on the lower polishing plate in the radial direction;

moving the upper polishing plate downward, by the holding unit, until the upper polishing plate contacts the roller member; and simultaneously adhering the polishing pads onto the upper and lower polishing plate by rotating the upper and polishing plates in the opposite directions at the same speed with pressing the roller member by the upper polishing plate.

Another method is a method of adhering polishing pads in a polishing apparatus including: a lower polishing plate having a polishing face, on which the polishing pad is adhered; an upper polishing plate being provided above the lower polishing plate and held by a holding unit, the upper polishing plate having a polishing face, on which the polishing pad is adhered; a carrier for holding a work piece, the carrier being provided on the lower polishing plate and engaged with a sun gear and an internal gear, wherein an upper face and a lower face of the work piece are simultaneously polished by rotating and moving the carrier around the sun gear and rotating the upper and lower polishing plates, the method comprises the steps of:

tentatively adhering the polishing pads to the upper and lower polishing plates;

attaching a roller unit having a shaft, which includes connector sections to be attached to the sun gear and the internal gear, and a plurality of split roller members, which is capable of rotating about the shaft, to the sun gear and the internal gear by the connector sections so as to attach the roller unit on the lower polishing plate in the radial direction;

moving the upper polishing plate downward, by the holding unit, until the upper polishing plate contacts the split roller members; and simultaneously adhering the polishing pads onto the upper and lower polishing plate by rotating the upper and polishing plates in the opposite directions at the same speed with pressing the split roller members by the upper polishing plate.

In each of the methods, the roller unit attached to the lower polishing plate may be movable upward and downward. With this method, the roller member can be clamped by the polishing plates with a proper pressing force, so that the polishing pads can be correctly and securely adhered on the polishing plates.

In the method, a plurality of the roller units may be set between the sun gear and the internal gear, and tracks of ends of the split roller members of one of the roller units may not overlap those of another roller unit.

Further, the roller units may have the same structures, and a direction of setting one of the roller units with respect to the sun gear and the internal gear may be opposite to that of another roller unit, so that the tracks of the ends of the split roller members of one of the roller units do not overlap those of another roller unit.

With these methods, the polishing pads can be securely adhered on the polishing faces of the polishing plates even if the split roller members have joint sections.

In the method, the sun gear and the internal gear may be constituted by pin gear units, and the connector sections of the shaft may be a cylindrical members, which are capable of engaging with prescribed pin gears corresponding to the sun gear and the internal gear from the upper side. With this method, the connector sections can be easily attached to the sun gear and the internal gear, abrasion of the gears can be restrained, and their good conditions can be maintained for a long time.

The jig is capable of adhering polishing pads of a polishing apparatus including: a lower polishing plate having a polishing face, on which the polishing pad is adhered; an upper polishing plate being provided above the lower polishing plate and held by a holding unit, the upper polishing plate having a polishing face, on which the polishing pad is adhered; a carrier for holding a work piece, the carrier being provided on the lower polishing plate and engaged with a sun gear and an internal gear, wherein an upper face and a lower face of the work piece are simultaneously polished by rotating and moving the carrier around the sun gear and rotating the upper and lower polishing plates, the jig comprises a roller unit having a shaft, which includes connector sections to be attached to the sun gear and the internal gear, and a roller member, which is capable of rotating about the shaft and which has a projected section having a prescribed width and being spirally formed in an outer circumferential face, and the roller unit can be set on the lower polishing plate, from which the carrier is detached, in the radial direction.

Another jig is capable of adhering polishing pads in a polishing apparatus including: a lower polishing plate having a polishing face, on which the polishing pad is adhered; an upper polishing plate being provided above the lower polishing plate and held by a holding unit, the upper polishing plate having a polishing face, on which the polishing pad is adhered; a carrier for holding a work piece, the carrier being provided on the lower polishing plate and engaged with a sun gear and an internal gear, wherein an upper face and a lower face of the work piece are simultaneously polished by rotating and moving the carrier around the sun gear and rotating the upper and lower polishing plates, the jig comprising a roller unit having a shaft, which includes connector sections to be attached to the sun gear and the internal gear, and a plurality of split roller members, which is capable of rotating about the shaft, and the roller unit can be set on the lower polishing plate, from which the carrier is detached, in the radial direction.

In each of the jigs, the sun gear and the internal gear may be constituted by pin gear units, and the connector sections of the shaft may be a cylindrical members, which are capable of engaging with prescribed pin gears corresponding to the sun gear and the internal gear from the upper side. With this structure, the connector sections can be easily attached to the sun gear and the internal gear, abrasion of the gears can be restrained, and their good conditions can be maintained for a long time.

In the jig, a plurality of the roller units may be set between the sun gear and the internal gear, and positions of ends of the split roller members of one of the roller units may not coincided with those of another roller unit. With this structure, non-pressed parts of the polishing pads, which are formed by joint sections between the split roller members, can be eliminated, the entire surfaces of the polishing pads can be securely pressed, and the polishing pads can be highly precisely adhered on the polishing faces of the polishing plates.

Further, the roller units may have the same structures, and positions of the ends of the split roller members from the connector sections in one of the roller units may not coincided with those in another roller unit. With this structure, the roller unit capable of securely adhering the polishing pads onto the polishing faces of the polishing plates can be provided with a low production cost.

By employing the method and the jig of the present invention, the polishing pads can be highly precisely adhered onto the polishing faces of the upper and the lower polishing plates without damaging the polishing pads.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

First Embodiment

Figure 1:
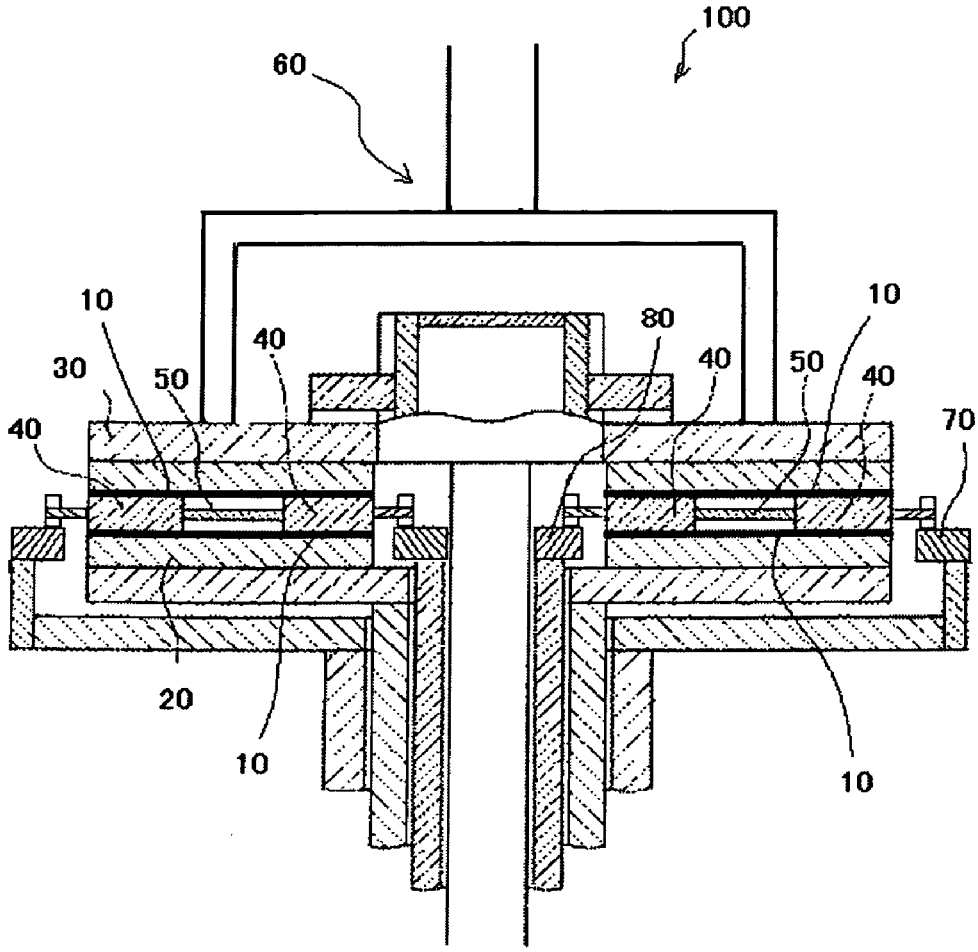
FIG. 1 is a partial sectional view of a polishing apparatus of a first embodiment of the present invention.
Figure 2:
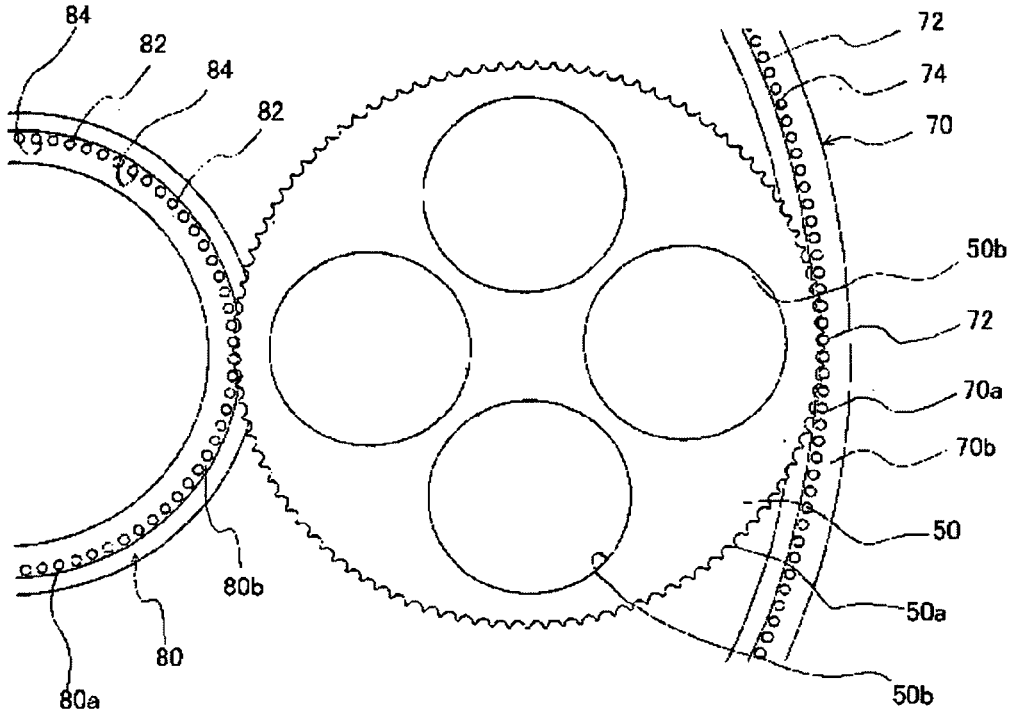
FIG. 2 is an explanation view of a drive mechanism for rotating carriers.

FIG. 1 is a partial sectional view of a polishing apparatus of a first embodiment, and FIG. 2 is an explanation view of a drive mechanism for rotating carriers.

As shown in FIG. 1, the polishing apparatus 100 has a lower polishing plate 20 and an upper polishing plate 30, which are independently rotated in the opposite directions. Polishing pads 10 are respectively adhered on polishing faces of the polishing plates 20 and 30. Carriers 50, each of which holds work pieces 40, are orbited between the polishing plates 20 and 30, so that both side faces of the work pieces 40 can be simultaneously polished by the polishing pads 10 adhered on the polishing plates 20 and 30. The upper polishing plate 30 is held by a holding unit 60, e.g., cylinder unit, so as to move the upper polishing plate 30 close to and away from the lower polishing plate 20.

To orbit the carriers 50, a drive mechanism shown in FIG. 2 is used. The drive mechanism includes an internal gear 70 and a sun gear 80, which is located at the center of the internal gear 70.

The internal gear 70 and the sun gear 80 are independently rotated. Outer teeth 50*a* are formed in outer circumferential faces of the disk-shaped carriers 50 and engaged with inner teeth 70*a* of the internal gear 70 and outer teeth 80*a* of the sun gear 80. With this structure, the carriers 50 moves around the sun gear 80 with rotating about its own axis.

A plurality of the carriers 50 are provided between the internal gear 70 and the sun gear 80, and each of the carriers 50 has a plurality of through-holes 50*b*, in each of which the work piece 40 to be polished is held. Therefore, many of the work pieces 40 can be polished simultaneously.

In the present embodiment, the sun gear 80 is constituted by a known pin gear unit. Namely, as shown in FIG. 2, an outer part of the sun gear 80, which is a main body part of the gear, has an inner pin ring 80*b*, which is formed like a circular disk. The outer teeth 80*a* are constituted by a plurality of tooth sections 82. Each of the tooth sections 82 is constituted by gear pins. The tooth sections 82 are arranged in the circumferential direction of the inner pin ring 80*b* at the regular intervals.

The internal gear 70 is also constituted by a known pin gear unit. Namely, as shown in FIG. 2, an inner part of the internal gear 70, which is a main body part of the gear, has an outer pin ring 70*b*, which is formed like a donut-shaped circular disk. The tooth sections 72 are arranged in the circumferential direction of the outer pin ring 70*b* at the regular intervals.

Figure 3:
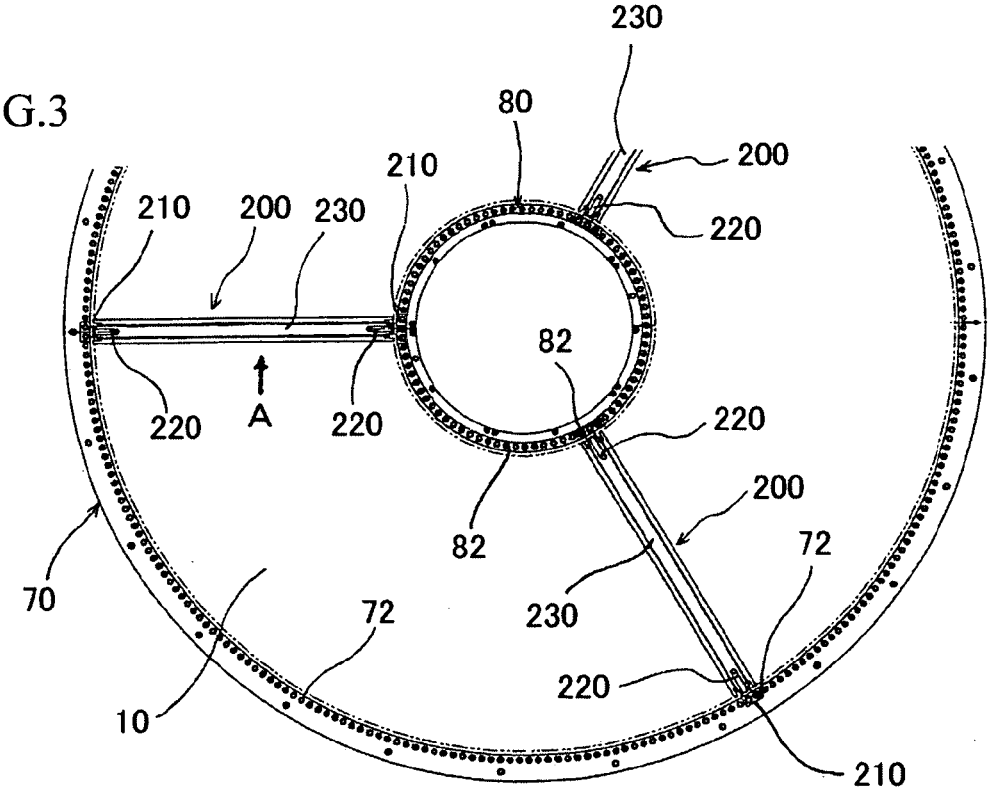
FIG. 3 is a plan view of a lower polishing plate, on which roller units are set.
Figure 4:
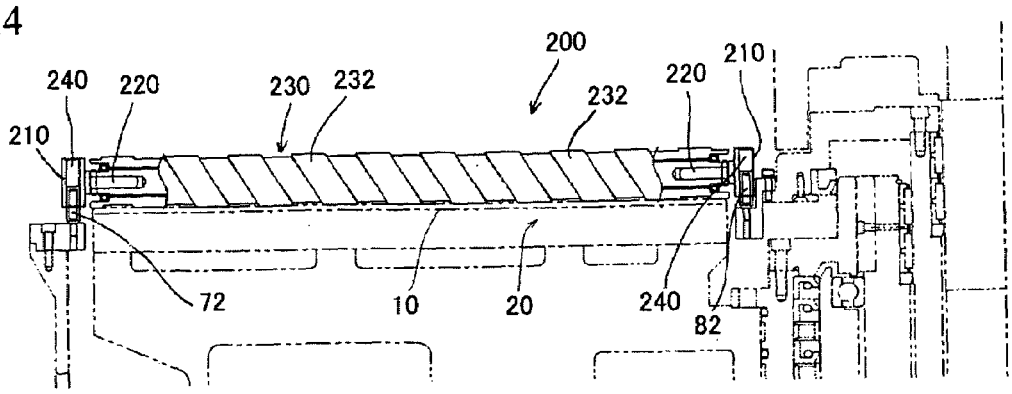
FIG. 4 is a view seen in the direction of the arrow "A" in FIG. 3.

Next, roller units 200, which are used as jigs for adhering the polishing pads 10, will be explained. FIG. 3 is a plan view of the lower polishing plate, on which the roller units 200 are set, and FIG. 4 is a view seen in the direction of the arrow "A" in FIG. 3. FIG. 4 is a partial transparent view.

In FIG. 3, each of the roller units 200 comprises: a shaft 220; a roller member 230 capable of rotating about the shaft 220; and connector sections 210 provided to the shaft 220 so as to attach the shaft 220 to the internal gear 70 and the sun gear 80.

As shown in FIG. 4, a projected section 232 having a prescribed width is spirally formed in an outer circumferential face the roller member 230. The spirally projected section 232 of the roller member 230 discharges air, which exists between the polishing faces of the polishing plates 20 and 30 and the polishing pads 10 adhered thereon, toward outside of the polishing plates 20 and 30 by rotating the roller member 230, so that the polishing pads 10 can be highly tightly adhered on the polishing plates 20 and 30.

Further, the spirally projected section 232 modifies influences caused by velocity difference between a circumferential velocity of an inner part of each polishing plate 20 and 30 and that of an outer part thereof. Namely, the circumferential velocities of the outer parts of the polishing plates 20 and 30 are faster than those of the inner parts thereof. Therefore, a frictional force between one part of the roller member 230, which contacts the outer parts of the polishing plates 20 and 30, and the polishing plates 20 and 30 is different from that between the other part of the roller member 230, which contacts the inner parts of the polishing plates 20 and 30, and the polishing plates 20 and 30. Degrees of abrading the polishing pads 10 in the inner parts and the outer parts are different. However, by a spiral groove section formed along the projected section 232, the frictional forces can be reduced.

Insert holes 240 are formed in the connector section 210. The tooth sections (gear pins) 72 and 82 of the internal gear 70 and the sun gear 80 are respectively inserted in the insert holes 240. The tooth sections (gear pins) 72 and 82 of the internal gear 70 and the sun gear 80 are inserted into the insert holes 240 from the bottom side, so that each of the roller units 200 is spanned between the gears 70 and 80.

Each of the connector sections 210 is formed into a cylindrical shape, into which the tooth sections (gear pins) 72 and 82 can be inserted. With this structure, the roller units 200 can be vertically moved close to and away from the lower polishing plate 20. Therefore, when the holding unit 60 moves the upper polishing plate 30 toward the lower polishing plate 20, the roller units 200 are pressed onto the lower polishing plate 20 by the upper polishing plate 30. Therefore, the roller units 200 are located at a mid position between the polishing plates 20 and 30 and clamped by them with a prescribed clamping force.

Note that, the connector sections 210, which are respectively provided to both ends of the shaft 220, may have different shapes so as to correctly attach to the internal gear 70 and the sun gear 80. Further, identification means, which respectively correspond to the gears 70 and 80, may be provided to the connector sections 210.

Next, a method of adhering the polishing pads will be explained as a process for exchanging the polishing pads.

Firstly, the upper polishing plate 30 is moved away from the lower polishing plate 20 by actuating the holding unit 60, e.g., cylinder unit. Then, the carriers 50, which have been engaged with the internal gear 70 and the sun gear 80, are disengaged from the gears 70 and 80. The abraded polishing pads 10 are removed from the polishing faces of the polishing plates 20 and 30, the polishing faces are cleaned, and the new polishing pads 10 are tentatively adhered onto the polishing faces of the polishing plates 20 and 30. Adhering means, e.g., double-stick tape, are adhered on adhering faces of the polishing pads 10.

Note that, in case of newly adhering the polishing pads 10, the step of removing the abraded pads 10 from the polishing plates 20 and 30 and the step of cleaning the polishing faces can be omitted.

After the new polishing pads 10 are tentatively adhered on the polishing faces of the polishing plates 20 and 30, the roller units 200 are set on the upper face of the lower polishing plate 20 in the radial directions. After the roller units 200 are set on the lower polishing plate 20 instead of the carriers 50, the upper polishing plate 30 is moved toward the roller units 200 and the lower polishing plate 20 by the holding unit 60. When the upper polishing plate 30 presses the roller member 230 of the roller units 200 onto the lower polishing plate 20 (in a state of clamping the roller member between the polishing plates 20 and 30), the polishing plates 20 and 30 are rotated in the opposite directions, by driving means, e.g., motors, at the same speed. Note that, the internal gear 70 and the sun gear 80 are not rotated.

With this action, the roller members 230 of the roller units 200 are rotated between the polishing plates 20 and 30, which are rotated in the opposite directions. By rotating the roller member 230, the spirally projected section 232 formed in the outer circumferential face of the roller member 230 is rotated, so that air existing between the polishing faces of the polishing plates 20 and 30 and the polishing pads 10 is discharged toward outside of the polishing plates 20 and 30.

Therefore, the polishing pads 10, which have been tentatively adhered on the polishing plates 20 and 30, can be tightly adhered.

As described above, the spirally projected section 232 modifies the influences caused by the velocity difference between the circumferential velocity of the inner part of each polishing plate 20 and 30 and that of the outer part thereof.

After the polishing pads 10 are fully adhered on the polishing plates 20 and 30, the upper polishing plate 30 is moved away from the lower polishing plate 20 and the roller units 200 by the holding unit 60. Then, the roller units 200 are detached from the lower polishing plate 20, and the carriers 50 are set thereon. The carriers 50 are set in the converse order, so explanation will be omitted.

Second Embodiment

In the first embodiment, the roller member 230 is rarely slipped by the velocity differences between the circumferential velocities of the inner parts of the polishing plates 20 and 30 and those of the outer parts thereof. Thus, in the present embodiment, a plurality of split roller members 234, which are arranged in the axial direction of the shaft 220, are used as the roller member 230 of one roller unit 200. A plurality of the roller units 200 are set in the radial directions of the internal gear 70 and the sun gear 80, as well as the first embodiment. Note that, the elements explained in the first embodiments are assigned the same symbols and explanation will be omitted.

Figure 5:
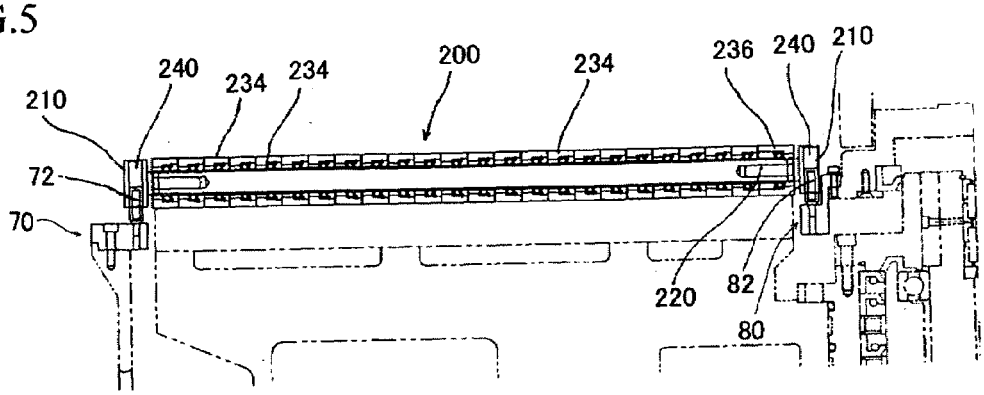
FIG. 5 is an explanation view of a roller unit of a second embodiment.
Figure 6:
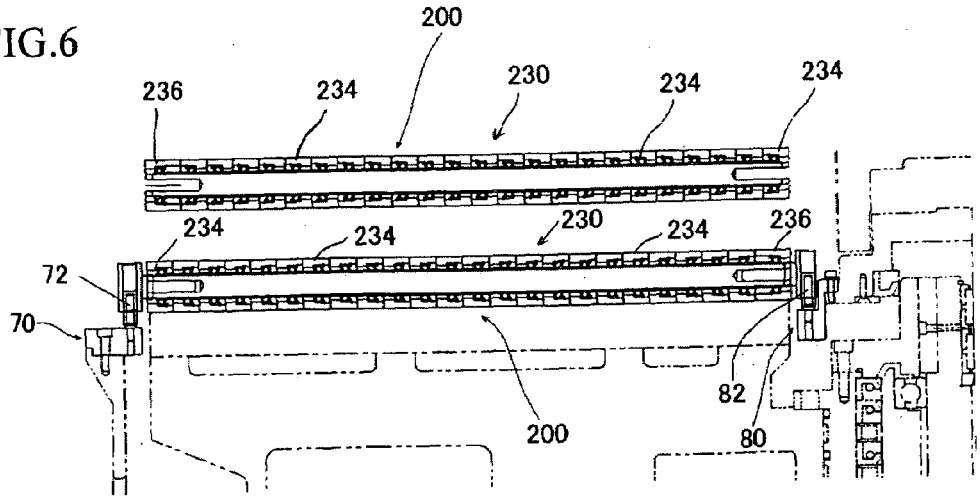
FIG. 6 is an explanation view of the roller unit shown in FIG. 5 and another roller unit reversely attached.
Figure 7:
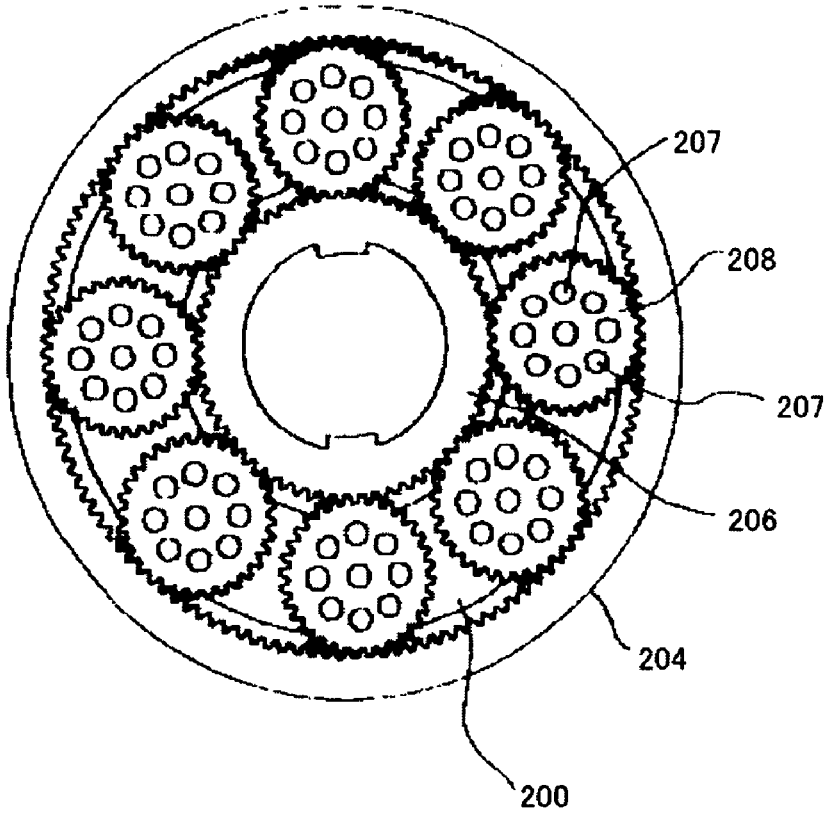
FIG.7 PRIOR ART
FIG. 7 is a plan view of the conventional mechanism for rotating the carriers.

FIG. 5 shows a structure of the roller unit of the second embodiment. FIG. 6 is an explanation view of the roller unit shown in FIG. 5 and another roller unit reversely attached.

As shown in FIG. 5, the split roller members 234 are cylindrical members, whose length is considerably shorter than that of the shaft 220. One of the roller units 200 includes a plurality of the split roller members 234, which rotatably cover the shaft 220.

The velocity differences increase with extending the axial length of the roller members. In the present embodiment, each of the roller members 230 is constituted by a plurality of the short split roller members 234, so that the velocity difference with respect to one split roller member 234 can be reduced even if the polishing plates are large. Therefore, amount of slippage of the roller member 230 constituted by the split roller members 234 is much smaller than that of the single roller member. By reducing the amount of slippage, damaging the polishing pads 10 by the roller members 230 can be prevented, so that the polishing pads 10 can be highly precisely adhered onto the polishing faces of the polishing plates.

On the other hand, by using the roller member 230 constituted by the split roller members 234, joint sections must be formed between the adjacent split roller members 234. To solve the problem of forming the joint sections, a plurality of the roller units 200 are used. In this case, positions of the joint sections of one of the roller units 200 are shifted from those of another roller unit 200. With this structure, tracks of ends of the split roller members 234 of one of the roller units 200 do not overlap those of another roller unit 200, so that the polishing pads 10 can be uniformly pressed. Therefore, the polishing pads 10 can be highly precisely adhered onto the polishing faces of the polishing plates.

To displace positions of the ends of the split roller members 234, a plurality of the roller units 200 having the same structure are prepared. In each of the roller units 200, one of the split roller members 234 is used as a spacer roller member 236, whose length is different from that of other split roller members 234. In this case, the length of the spacer roller member is not integral multiple of the length of other split roller members 234. Further, a setting direction of one of the roller units 200 with respect to the lower polishing plate 20 is opposite to those of other roller units 200. For example, as shown in FIG. 6, in one of the roller units 200 set on the lower polishing plate 20, one of the connector section 210 is connected to the tooth section 82 of the sun gear 80, and the other connector section 210 is connected to the tooth section 72 of the internal gear 70; in each of other roller units 200 set on the lower polishing plate 20, one of the connector section 210 is connected to the tooth section 72 of the internal gear 70, and the other connector section 210 is connected to the tooth section 82 of the sun gear 80.

With this structure, the joint sections of one of the roller units 200 are shifted from those of other roller units 200, so that the polishing pads 10 can be securely uniformly pressed by the roller members 230.

Further, the lengths of the spacer roller members 236 of the roller units 200 may be mutually different. In this case, a production cost is increased, but the roller units 200 can be easily set on the lower polishing plate 20 without considering directions of the roller units 200.

Note that, the polishing pads 10 can be adhered as well as the first embodiment, so explanation of the method will be omitted.

In the above described embodiments, the lower polishing plate 20 and the upper polishing plate 30 are rotated in the opposite directions at the same speed, but the rotational speeds may be different. In this case, the internal gear 70 and the sun gear 80 are rotated so as to produce the similar structure. If the lower polishing plate 20 and the upper polishing plate 30 can be relatively rotated in the opposite direction with respect to the roller member or members 230 at the same speed and they do not interfere the rotation of the roller member or members 230, means for rotating the lower polishing plate 20 and the upper polishing plate 30 is not limited.

Further, the lower polishing plate 20, the upper polishing plate 30, the internal gear 70 and the sun gear 80 may be rotated by independent drive sources (not shown), e.g., motors. On the other hand, they may be rotated by one drive source, whose torque is transmitted by gears and clutches.

In the above described embodiments, the internal gear 70 and the sun gear 80 are the pin gear units, but they are not limited to the embodiments.

The invention may be embodied in other specific forms without departing from the spirit of essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of adhering polishing pads in a polishing apparatus including: a lower polishing plate (20) having a polishing face, on which said polishing pad (10) is adhered; an upper polishing plate (30) being provided above said lower polishing plate (20) and held by a holding unit (60), said upper polishing plate (30) having a polishing face, on which said polishing pad (10) is adhered; a carrier (50) for holding a work piece (40), said carrier (50) being provided on said lower polishing plate (20) and engaged with a sun gear (80) and an internal gear (70), wherein an upper face and a lower face of the work piece (40) are simultaneously polished by rotating and moving said carrier (50) around the sun gear (80) and rotating said upper and lower polishing plates 20, 30), said method comprising the steps of:

tentatively adhering said polishing pads (10) to said upper and lower polishing plates (20, 30);

attaching a roller unit (200) having a shaft (220), which includes connector sections (210) to be attached to the sun gear (80) and the internal gear (70), and a roller member (230), which is capable of rotating about the shaft (220) and which has a projected section (232) having a prescribed width and being spirally formed in an outer circumferential face, to the sun gear (80) and the internal gear (70) by the connector sections (210) so as to attach the roller unit (200) on said lower polishing plate (20) in the radial direction;

moving said upper polishing plate (30) downward, by the holding unit (60), until said upper polishing plate (30) contacts the roller member (230); and simultaneously adhering said polishing pads (10) onto said upper and lower polishing plate (20, 30) by rotating said upper and lower polishing plates (20, 30) in the opposite directions at the same speed with pressing the roller member (230) by said upper polishing plate (30).

2. The method according to claim 1, wherein the roller unit (200) attached to said lower polishing plate (20) is movable upward and downward.

3. The method according to claim 2, wherein the sun gear (80) and the internal gear (70) are constituted by pin gear units , and the connector sections (210) of the shaft (220) are cylindrical members, which are capable of engaging with prescribed pin gears corresponding to the sun gear (80) and the internal gear (70) from the upper side.

4. A method of adhering polishing pads (10) in a polishing apparatus including: a lower polishing plate (20) having a polishing face, on which said polishing pad (10) is adhered; an upper polishing plate (30) being provided above said lower polishing plate (20) and held by a holding unit (60), said upper polishing plate (30) having a polishing face, on which said polishing pad (10) is adhered; a carrier (50) for holding a work piece (40), said carrier (50) being provided on said lower polishing plate (20) and engaged with a sun gear (80) and an internal gear (70), wherein an upper face and a lower face of the work piece (40) are simultaneously polished by rotating and moving said carrier (50) around the sun gear (80) and rotating said upper and lower polishing plates (20, 30), said method comprising the steps of:

tentatively adhering said polishing pads (10) to said upper and lower polishing plates (20, 30);

attaching a roller unit (200) having a shaft (220), which includes connector sections (210) to be attached to the sun gear (80) and the internal gear (70), and a plurality of split roller members (230), which is capable of rotating about the shaft (220), to the sun gear (80) and the internal gear (70) by the connector sections (210) so as to attach the roller unit (200) on said lower polishing plate (20) in the radial direction;

moving said upper polishing plate (30) downward, by the holding unit (60), until said upper polishing plate (30) contacts the split roller members (234); and simultaneously adhering said polishing pads (10) onto said upper and lower polishing plate (20, 30) by rotating said upper and lower polishing plates (20, 30) in the opposite directions at the same speed with pressing the split roller members (234) by said upper polishing plate (30).

5. The method according to claim 4, wherein the roller unit (200) attached to said lower polishing plate (20) is movable upward and downward.

6. The method according to claim 5, wherein the sun gear (80) and the internal gear (70) are constituted by pin gear units, and the connector sections (210) of the shaft (220) are cylindrical members, which are capable of engaging with prescribed pin gears corresponding to the sun gear (80) and the internal gear (70) from the upper side.

7. The method according to claim 4, wherein a plurality of the roller units (200) are set between the sun gear (80) and the internal gear (70), and tracks of ends of the split roller members (234) of one of the roller units (200) do not overlap those of another roller unit (200).

8. The method according to claim 7, wherein the roller units (200) have the same structures, and a direction of setting one of the roller units (200) with respect to the sun gear (80) and the internal gear (70) is opposite to that of another roller unit (200), whereby the tracks of the ends of the split roller members (234) of one of the roller units (200) do not overlap those of another roller unit (200).

9. A jig for adhering polishing pads (10) of a polishing apparatus including: a lower polishing plate (20) having a polishing face, on which said polishing pad (10) is adhered; an upper polishing plate (30) being provided above said lower polishing plate (20) and held by a holding unit (60), said upper polishing plate (30) having a polishing face, on which said polishing pad (10) is adhered; a carrier (50) for holding a work piece (40), said carrier (50) being provided on said lower polishing plate (20) and engaged with a sun gear (80) and an internal gear (70), wherein an upper face and a lower face of the work piece (40) are simultaneously polished by rotating and moving said carrier (50) around the sun gear (80) and rotating said upper and lower polishing plates (20, 30), said jig comprising a roller unit (200) having a shaft (220), which includes connector sections (210) to be attached to the sun gear (80) and the internal gear (70), and a roller member (230), which is capable of rotating about the shaft (220) and which has a projected section (232) having a prescribed width and being spirally formed in an outer circumferential face, wherein the roller unit (200) can be set on said lower polishing plate (20), from which the carrier (50) is detached, in the radial direction.

10. The jig according to claim 9, wherein the sun gear (80) and the internal gear (70) are constituted by pin gear units, and the connector sections (210) of the shaft are cylindrical members, which are capable of engaging with prescribed pin gears corresponding to the sun gear (80) and the internal gear (70) from the upper side.

11. A jig for adhering polishing pads (10) in a polishing apparatus including: a lower polishing plate (20) having a polishing face, on which said polishing pad (10) is adhered; an upper polishing plate (30) being provided above said lower polishing plate (20) and held by a holding unit (60), said upper polishing plate (30) having a polishing face, on which said polishing pad (10) is adhered; a carrier (50) for holding a work piece (40), said carrier (50) being provided on said lower polishing plate (20) and engaged with a sun gear (80) and an internal gear (70), wherein an upper face and a lower face of the work piece (40) are simultaneously polished by rotating and moving said carrier (50) around the sun gear (80) and rotating said upper and lower polishing plates (20, 30), said jig comprising a roller unit (200) having a shaft (220), which includes connector sections (210) to be attached to the sun gear (80) and the internal gear (70), and a plurality of split roller members (234), which is capable of rotating about the shaft (220), wherein the roller unit (200) can be set on said lower polishing plate (20), from which the carrier (50) is detached, in the radial direction.

12. The jig according to claim 11, wherein the sun gear (80) and the internal gear (70) are constituted by pin gear units, and the connector sections (210) of the shaft (220) are cylindrical members, which are capable of engaging with prescribed pin gears corresponding to the sun gear (80) and the internal gear (70) from the upper side.

13. The jig according to claim 11, wherein a plurality of the roller units (200) are set between the sun gear (80) and the internal gear (70), and positions of ends of the split roller members (234) of one of the roller units (200) are not coincided with those of another roller unit (200).

14. The method according to claim 13, wherein the roller units (200) have the same structures, and positions of the ends of the split roller members (234) from the connector sections (210) in one of the roller units (200) are not coincided with those in another roller unit (200).

* * * * *